US008857189B2

(12) United States Patent
Matsuyama et al.

(10) Patent No.: US 8,857,189 B2
(45) Date of Patent: Oct. 14, 2014

(54) GAS TURBINE COMBUSTION BURNER

(75) Inventors: Keisuke Matsuyama, Tokyo (JP); Takanori Ito, Tokyo (JP); Tei Yamato, Tokyo (JP); Koji Maeta, Tokyo (JP); Sosuke Nakamura, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/495,499

(22) Filed: Jun. 13, 2012

(65) Prior Publication Data

US 2013/0000306 A1 Jan. 3, 2013

(30) Foreign Application Priority Data

Dec. 2, 2009 (JP) ..... 2009-274516

(51) Int. Cl.
*F02C 7/24* (2006.01)
*F02C 1/00* (2006.01)
*F23R 3/28* (2006.01)

(52) U.S. Cl.
CPC ..... *F23R 3/28* (2013.01); *F23R 2900/00014* (2013.01)
USPC ..... 60/725; 60/740

(58) Field of Classification Search
USPC ..... 60/725, 734, 739, 740, 742, 746
See application file for complete search history.

(56) References Cited

U.S. PATENT DOCUMENTS 4,932,861 A * 6/1990 Keller et al. ..... 431/8
5,373,695 A * 12/1994 Aigner et al. ..... 60/804
5,586,878 A * 12/1996 Dobbeling et al. ..... 431/351
6,250,602 B1 * 6/2001 Jansen ..... 251/129.11
6,490,864 B1 * 12/2002 Joos et al. ..... 60/725
6,615,587 B1 * 9/2003 Schulze ..... 60/737
7,464,552 B2 * 12/2008 Sattinger ..... 60/725
7,520,745 B2 * 4/2009 Oomens et al. ..... 431/354
2006/0191268 A1 * 8/2006 Widener et al. ..... 60/772

FOREIGN PATENT DOCUMENTS

JP 62-237039 A 10/1987
JP 8-296852 A 11/1996
JP 9-280073 A 10/1997
JP 2000-193242 A 7/2000
JP 2001-289441 A 10/2001
JP 2002-340278 A 11/2002
JP 2006-105488 A 4/2006
JP 2008-121961 A 5/2008

OTHER PUBLICATIONS

Japanese Office Action dated Sep. 17, 2013, issued in Japanese Patent Application No. 2009-274516, w/English translation.
Office Action dated Dec. 3, 2013 issued in Japanese Patent Application 2009-274516. The Decision to Grant a Patent has been received.

* cited by examiner

*Primary Examiner* — Phutthiwat Wongwian
*Assistant Examiner* — Scott Walthour
(74) *Attorney, Agent, or Firm* — Westerman, Hattori, Daniels & Adrian, LLP

(57) ABSTRACT

In a gas-turbine combustion burner which is provided, at a distal end thereof, with a fuel spraying hole that sprays fuel into a combustion region formed inside a combustion cylinder of a gas-turbine combustor and in which a fuel flow path that guides the fuel, which is supplied from a fuel source, to the fuel spraying hole is formed in the interior thereof, the impedance of a fuel supply system that guides the fuel from the fuel source to the fuel spraying hole is set so that propagation of pressure fluctuations from the combustion region to the fuel supply system becomes an allowable level or less.

8 Claims, 7 Drawing Sheets

GAS TURBINE COMBUSTION BURNER

TECHNICAL FIELD

The present invention relates to a gas-turbine combustion burner applied to a gas-turbine combustor.

BACKGROUND ART

In a combustion region formed inside a combustion cylinder of a gas-turbine combustor, pressure fluctuations are generated by flames, those pressure fluctuations propagate (feed back) to a gas-turbine combustion burner, the flow rate of fuel sprayed (ejected) into the combustion region from fuel spraying holes in the gas-turbine combustion burner fluctuates, and that flow-rate fluctuation propagates to the flames, aggravating the pressure fluctuations.

Therefore, one known way to suppress the pressure fluctuations in the combustion region is to use an acoustic liner disclosed, for example, in Patent Literature 1.

CITATION LIST

Patent Literature

{PTL 1} Japanese Unexamined Patent Application, Publication No. 2008-121961

SUMMARY OF INVENTION

Technical Problem

However, the acoustic liner disclosed in Patent Literature 1 is based on the technical idea of suppressing pressure fluctuations in the combustion region and suppressing pressure fluctuations that propagate to the gas-turbine combustion burner, to suppress flow-rate fluctuations in the fuel sprayed into the combustion region from fuel spraying holes in the gas-turbine combustion burner, and is not based on the technical idea of increasing the impedance (resistance) in the fuel supply system to reduce the propagation of pressure fluctuations from the combustion region to the fuel supply system. In addition, if the pressure fluctuations in the combustion region remarkably increase for some reason, it is not possible to sufficiently suppress the pressure fluctuations in the combustion region with, for example, just the acoustic liner disclosed in Patent Literature 1, and the pressure fluctuations in the combustion region become a problem.

The present invention has been conceived in light of the circumstances described above, and an object thereof is to provide a gas-turbine combustion burner that can reduce, as much as possible, the propagation of pressure fluctuations from the combustion region to the fuel supply system by increasing the impedance of the fuel supply system, thereby making it possible to reduce fluctuations in the flow rate of fuel sprayed into the combustion region from fuel spraying holes in the gas-turbine combustion burner.

Solution to Problem

In order to solve the problem described above, the present invention employs the following solutions.

A gas-turbine combustion burner according to the present invention is provided, at a distal end thereof, with a fuel spraying hole that sprays fuel into a combustion region formed inside a combustion cylinder of a gas-turbine combustor and in which a fuel flow path that guides the fuel, which is supplied from a fuel source, to the fuel spraying hole is formed in the interior thereof, wherein the impedance of a fuel supply system, which guides the fuel from the fuel source to the fuel spraying hole, is set so that propagation of pressure fluctuations from the combustion region to the fuel supply system becomes an allowable level or less.

A gas-turbine combustion burner according to the present invention is provided, at a distal end thereof, with a fuel spraying hole that sprays fuel into a combustion region formed inside a combustion cylinder of a gas-turbine combustor and in which a fuel flow path that guides the fuel, which is supplied from a fuel source, to the fuel spraying hole is formed in the interior thereof, wherein a hole diameter of the fuel spraying hole is set so that propagation of pressure fluctuations from the combustion region to a fuel supply system becomes an allowable level or less.

With the gas-turbine combustion burner according to the present invention, it is possible to reduce, as much as possible, the propagation of pressure fluctuations from the combustion region to the fuel supply system by increasing the impedance of the fuel spraying hole (in other words, the impedance of the fuel supply system that guides the fuel from a fuel source to the fuel spraying hole), thereby making it possible to reduce fluctuations in the flow rate of the fuel sprayed from the fuel spraying hole into the combustion region.

In the above-described gas-turbine combustion burner, preferably, the fuel spraying hole includes a reduced-diameter portion that extends from an inlet thereof to a point at ¼ of a flow path length thereof, a first straight portion that extends from the point at ¼ of the flow path length thereof to a point at ⅔ of the flow path length thereof, a wide-diameter portion that extends from the point at ⅔ of the flow path length thereof to a point at ¾ of the flow path length thereof, and a second straight portion that extends from the point at ¾ of the flow path length thereof to an outlet thereof.

With such a gas-turbine combustion burner, pressure losses occur at a first stepped portion (first edge portion) formed at the connecting portion between the first straight portion and the wide-diameter portion, and also at a second stepped portion (second edge portion) formed at the connecting portion between the wide-diameter portion and the second straight portion; therefore, the impedance of the fuel spraying hole becomes even larger, and thus the propagation of pressure fluctuations from the combustion region to the fuel supply system can be reduced even more, thereby making it possible to further reduce the fluctuations in the flow rate of the fuel sprayed from the fuel spraying hole into the combustion region.

In addition, a pressure loss occurs at a constricted portion formed at the connecting portion between the reduced-diameter portion and the first straight portion (in other words, where the outlet of the reduced-diameter portion meets the inlet of the first straight portion); therefore, the impedance of the fuel spraying hole becomes even larger, and thus the propagation of pressure fluctuations from the combustion region to the fuel supply system can be reduced even more, thereby making it possible to further reduce the fluctuations in the flow rate of the fuel sprayed from the fuel spraying hole into the combustion region.

In the above-described gas-turbine combustion burner, more preferably, an inner diameter of the wide-diameter portion is set to be 1.5 to 5 times an inner diameter of the first straight portion.

With such a gas-turbine combustion burner, it is possible to effectively reduce the noise of flowing fuel in the wide-diameter portion, whose inner diameter is set to be 1.5 to 5 times the inner diameter of the first straight portion.

In the above-described gas-turbine combustion burner, more preferably, the fuel spraying hole includes a reduced-diameter portion that extends from an inlet thereof to a point at ⅓ of a flow path length thereof, a straight portion that extends from the point at ⅓ of the flow path length thereof to a point at ⅔ of the flow path length thereof, and a wide-diameter portion that extends from the point at ⅔ of the flow path length thereof to an outlet thereof.

With such a gas-turbine combustion burner, a pressure loss occurs at a stepped portion (edge portion) formed at the connecting portion between the straight portion and the wide-diameter portion; therefore, the impedance of the fuel spraying hole becomes even larger, and thus the propagation of pressure fluctuations from the combustion region to the fuel supply system can be reduced even more, thereby making it possible to further reduce the fluctuations in the flow rate of the fuel sprayed from the fuel spraying hole into the combustion region.

Moreover, a pressure loss occurs at a constricted portion formed at the connecting portion between the reduced-diameter portion and the straight portion (in other words, where the outlet of the reduced-diameter portion meets the inlet of the straight portion); therefore, the impedance of the fuel spraying hole becomes even larger, and thus the propagation of pressure fluctuations from the combustion region to the fuel supply system can be reduced even more, thereby making it possible to further reduce the fluctuations in the flow rate of the fuel sprayed from the fuel spraying hole into the combustion region.

In the above-described gas-turbine combustion burner, more preferably, an inner diameter of the wide-diameter portion is set to be 1.5 to 5 times an inner diameter of the straight portion.

With such a gas-turbine combustion burner, it is possible to effectively reduce the noise of flowing fuel in the wide-diameter portion, whose inner diameter is set to be 1.5 to 5 times the inner diameter of the straight portion.

In the above-described gas-turbine combustion burner, more preferably, the fuel spraying hole includes a reduced-diameter portion that gradually reduces in diameter from an inlet thereof to an intermediate point in a flow path length thereof, and a wide-diameter portion that gradually increases in diameter from the intermediate point in the flow path length thereof to an outlet thereof.

With such a gas-turbine combustion burner, a pressure loss occurs at a constricted portion formed at the connecting portion between the reduced-diameter portion and the wide-diameter portion (in other words, where the outlet of the reduced-diameter portion meets the inlet of the wide-diameter portion); therefore, the impedance of the fuel spraying hole becomes even larger, and thus the propagation of pressure fluctuations from the combustion region to the fuel supply system can be reduced even more, thereby making it possible to further reduce the fluctuations in the flow rate of the fuel sprayed from the fuel spraying hole into the combustion region.

A gas-turbine combustion burner according to the present invention is provided, at a distal end thereof, with a fuel spraying hole that sprays fuel into a combustion region formed inside a combustion cylinder of a gas-turbine combustor and in which a fuel flow path that guides the fuel, which is supplied from a fuel source, to the fuel spraying hole is formed in the interior thereof, wherein the flow-path cross-sectional area of the fuel flow path is set so that propagation of pressure fluctuations from the combustion region to a fuel supply system becomes an allowable level or less.

With the gas-turbine combustion burner according to the present invention, it is possible to reduce, as much as possible, the propagation of pressure fluctuations from the combustion region to the fuel supply system by increasing the impedance of the fuel flow path (in other words, the impedance of the fuel supply system that guides the fuel from a fuel source to the fuel spraying hole), thereby making it possible to reduce fluctuations in the flow rate of the fuel sprayed from the fuel spraying hole into the combustion region.

In the above-described gas-turbine combustion burner, more preferably, a sound-absorbing material is provided at the radially outer side of the fuel flow path.

With such a gas-turbine combustion burner, pulsations in the fuel passing through the fuel flow path are absorbed by the sound-absorbing material, and therefore, (substantially) constant fuel can always be sprayed from the fuel spraying hole, making it possible to further reduce the fluctuations in the flow rate of the fuel sprayed from the fuel spraying hole into the combustion region.

A gas-turbine combustion burner according to the present invention is provided, at a distal end thereof, with a fuel spraying hole that sprays fuel into a combustion region formed inside a combustion cylinder of a gas-turbine combustor and in which a fuel flow path that guides the fuel, which is supplied from a fuel source, to the fuel spraying hole is formed in the interior thereof, wherein a baffle plate or orifice provided with a slit is provided in the fuel flow path so that propagation of pressure fluctuations from the combustion region to a fuel supply system becomes an allowable level or less.

With the gas-turbine combustion burner according to the present invention, it is possible to reduce, as much as possible, the propagation of pressure fluctuations from the combustion region to the fuel supply system by increasing the impedance of the fuel flow path (in other words, the impedance of the fuel supply system that guides the fuel from a fuel source to the fuel spraying hole), thereby making it possible to reduce fluctuations in the flow rate of the fuel sprayed from the fuel spraying hole into the combustion region.

In the above-described gas-turbine combustion burner, more preferably, the baffle plate or orifice is made of a sound-absorbing material.

With such a gas-turbine combustion burner, pulsations in the fuel passing through the fuel flow path are absorbed by the baffle plate made of the sound-absorbing material (or the orifice made of the sound-absorbing material), and therefore, (substantially) constant fuel can always be sprayed from the fuel spraying hole, which makes it possible to further reduce the fluctuations in the flow rate of the fuel sprayed from the fuel spraying hole into the combustion region.

A gas-turbine combustor according to the present invention includes one of the gas-turbine combustion burners described above.

With the gas-turbine combustor according to the present invention, (substantially) constant fuel is always sprayed form the fuel spraying hole, and therefore, it is possible to suppress (reduce) aggravation of the pressure fluctuations caused by fluctuations in the flow rate of the fuel sprayed into the combustion region from the fuel spraying hole in the gas-turbine combustion burner and those flow-rate fluctuations propagating to the flames.

Advantageous Effects of Invention

With the gas-turbine combustion burner according to the present invention, it is possible to reduce, as much as possible, the propagation of pressure fluctuations from a combustion region to a fuel supply system by increasing the impedance of the fuel supply system, thereby making it possible to reduce fluctuations in the flow rate of fuel that is sprayed into the combustion region from fuel spraying holes in the gas-turbine combustion burner.

DESCRIPTION OF EMBODIMENTS

Figure 1:
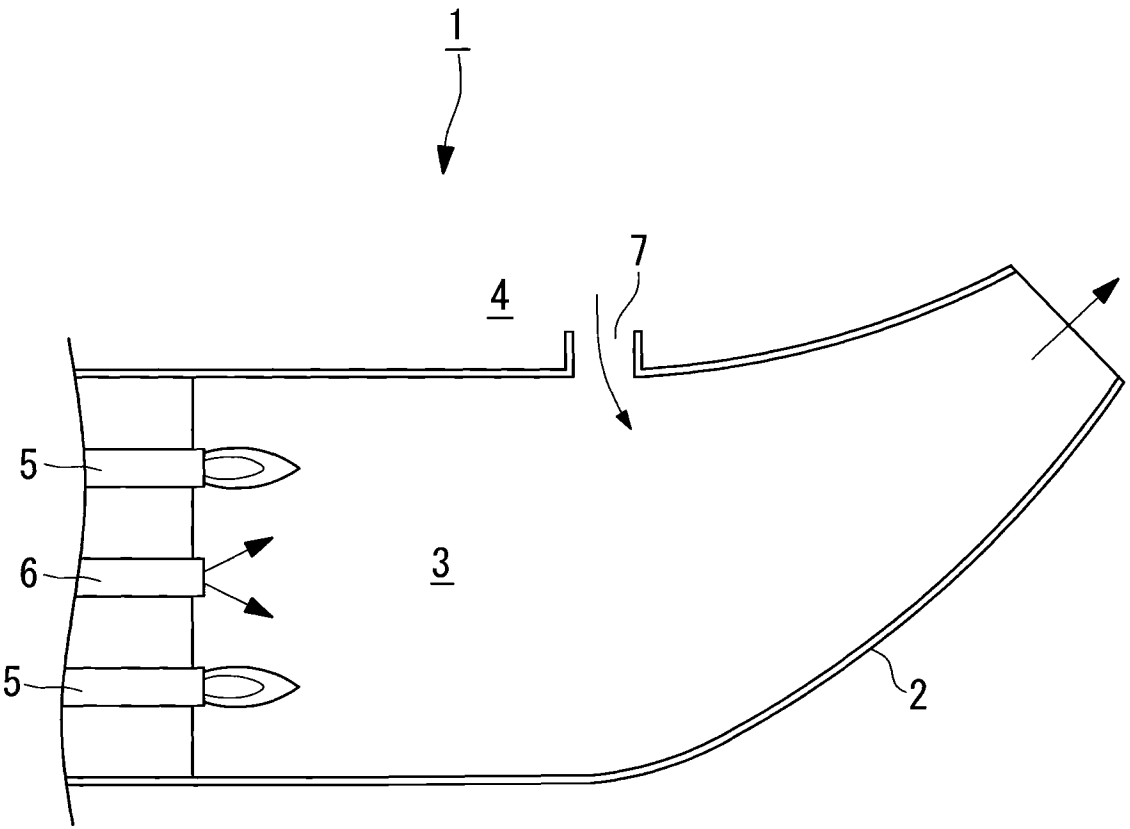
FIG. 1 is a cross-sectional view showing relevant parts of a gas-turbine combustor equipped with a gas-turbine combustion burner according to the present invention.
Figure 3:
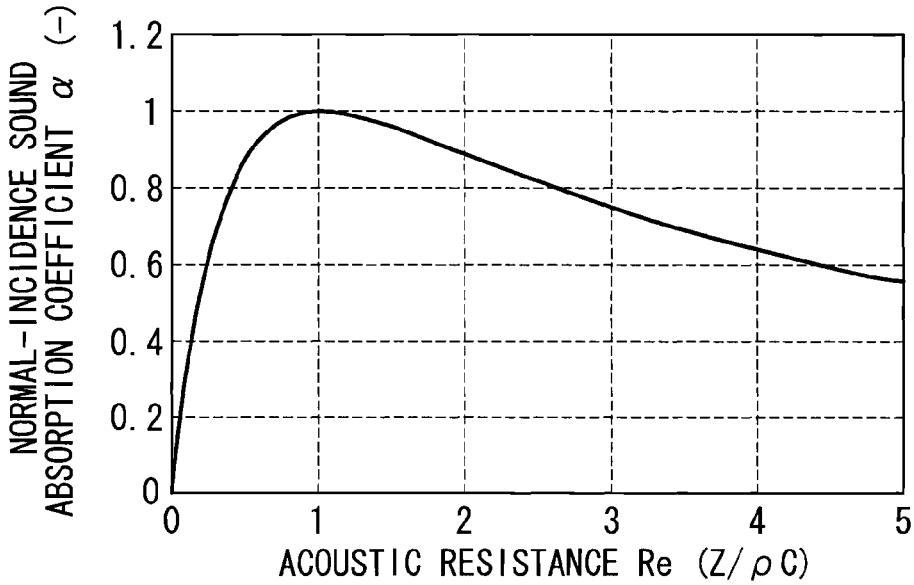
FIG. 3 is a graph showing the relationship between normal-incidence sound absorption coefficient $\alpha$ and acoustic resistance Re.
Figure 4:
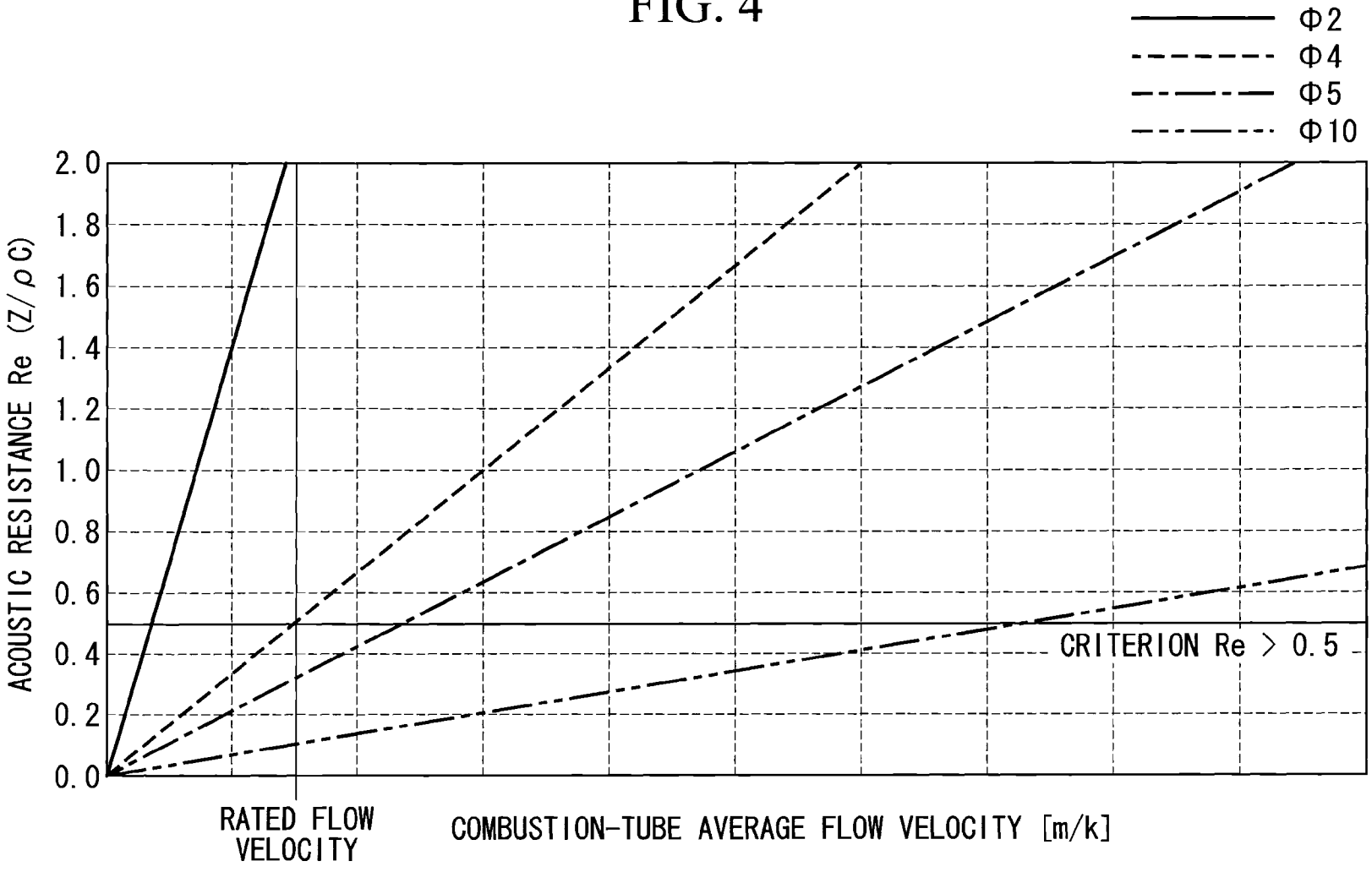
FIG. 4 is a graph showing the relationship between acoustic resistance Re and combustion-tube average flow velocity.

A gas-turbine combustion burner according to a first embodiment of the present invention will be described below with reference to FIGS. 1 to 4. FIG. 1 is a cross-sectional view showing relevant parts of a gas-turbine combustor equipped with a gas-turbine combustion burner according to the present invention, FIG. 2 is an enlarged view showing relevant parts of the gas-turbine combustion burner according to this embodiment, FIG. 3 is a graph showing the relationship between normal-incidence sound absorption coefficient $\alpha$ and acoustic resistance Re, and FIG. 4 is a graph showing the relationship between acoustic resistance Re and combustion-tube average flow velocity.

As shown in FIG. 1, a gas-turbine combustor (hereinafter referred to as "combustor") 1 equipped with a gas-turbine combustion burner according to the present invention includes a combustion cylinder 2. The combustion cylinder 2 forms a combustion region in the interior thereof and takes a tube-like form that communicates with a compressed airflow 4 at the exterior thereof. A plurality of (in this embodiment, eight) main combustion burners 5 and one pilot combustion burner (gas-turbine combustion burner) 6 are provided at the upstream side of the combustion cylinder 2. Also, a bypass flow path 7 for introducing air is provided in a wall located at the downstream side of the combustion cylinder 2.

The main combustion burners 5 are provided at equal intervals (45° intervals) in the circumferential direction, and the pilot combustion burner 6 is provided so as to be located at (substantially) the center of the main combustion burners 5.

Figure 2:
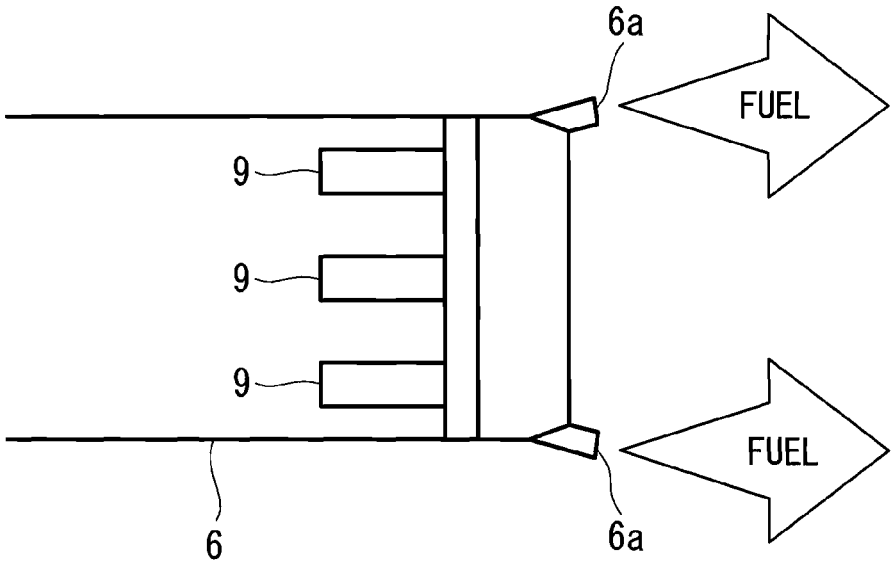
FIG. 2 is a magnified view showing relevant parts of a gas-turbine combustion burner according to a first embodiment of the present invention.

As shown in FIG. 2, a plurality of (fuel) spraying holes **6*a* are provided at the distal end (the end at the downstream side) of the pilot combustion burner 6, and inside the pilot combustion burner 6, a fuel passage 8 (see FIG. 6) that extends in the longitudinal direction (axial direction) thereof and that guides fuel from a base end of the pilot combustion burner 6 (the end at the upstream side) to the spraying holes 6*a* is provided. Thus, the fuel guided to the spraying holes 6*a* is sprayed (ejected) from the spraying holes 6*a* towards the combustion region 3 and is mixed with compressed air flowing in from the upstream side to form fuel gas, which is combusted in the combustion region 3**.

Reference signs 9 in FIG. 2 are ejection ports where oil is ejected (sprayed) in the case where the pilot combustion burner 6 is a dual-fired (using both gas and oil) nozzle.

The hole diameter of the spraying holes **6*a* according to this embodiment is determined using the graphs shown in FIGS. 3 and 4. Specifically, an acoustic resistance (also called "orifice resistance") Re=0.5 at which the normal-incidence sound absorption coefficient $\alpha$ is approximately 0.9 is selected using the graph shown in FIG. 3, and a hole diameter at which the acoustic resistance Re for the rated flow velocity (average flow velocity) of fuel flowing through the fuel passage (fuel pipe) provided inside the pilot combustion burner 6 is larger than 0.5 is obtained using the graph shown in FIG. 4. In other words, as shown in FIG. 4**, a hole diameter of $\phi 4$ (4 mm) or less is employed in this embodiment.

The normal-incidence sound absorption coefficient indicates how much a pressure wave propagated from the combustion region 3 to the spraying holes **6*a* is absorbed in the spraying holes 6*a*; when the value thereof is "1", the pressure wave propagated from the combustion region 3 to the spraying holes 6*a* is completely absorbed in the spraying holes 6*a*, and when the value thereof is "0", the pressure wave propagated from the combustion region 3 to the spraying holes 6*a* is completely reflected at the spraying holes 6*a***. Also, regarding the normal-incidence sound absorption coefficient, a value greater than "1" cannot exist; it must be "1" or less.

With the pilot combustion burner 6 according to this embodiment, it is possible to reduce, as much as possible, the propagation of pressure fluctuations from the combustion region 3 to the fuel supply system by increasing the impedance of the spraying holes **6*a* (in other words, the impedance of the fuel supply system that guides the fuel from a fuel source to the spraying holes 6*a*), thereby making it possible to reduce fluctuations in the flow rate of the fuel sprayed from the spraying holes 6*a* into the combustion region 3**.

Figure 5:
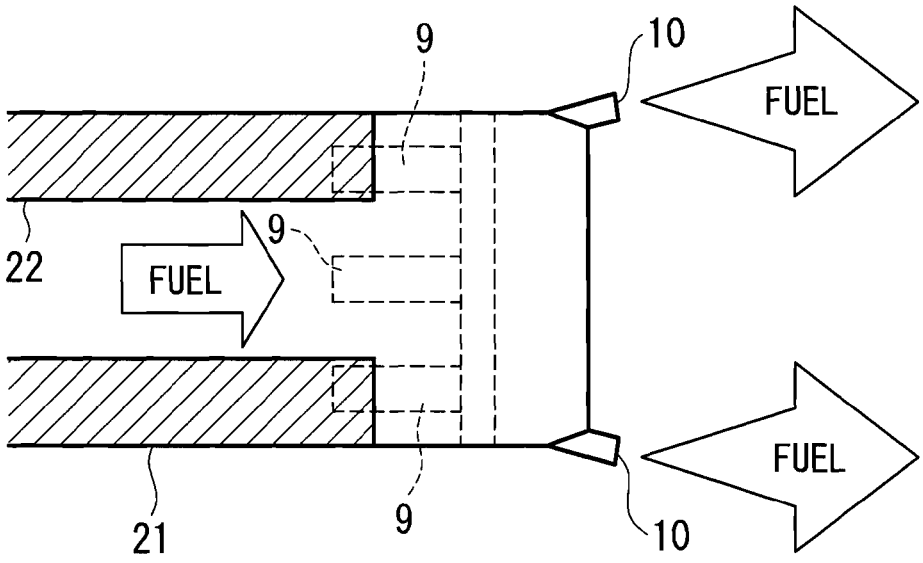
FIG. 5 is a cross-sectional view showing, in enlarged form, relevant parts of a gas-turbine combustion burner according to a second embodiment of the present invention.

A second embodiment of the gas-turbine combustion burner according to the present invention will be described with reference to FIG. 5. FIG. 5 is a cross-sectional view showing, in enlarged form, relevant parts of the gas-turbine combustion burner according to this embodiment.

A pilot combustion burner (gas-turbine combustion burner) 21 according to this embodiment differs from that of the first embodiment described above in that, instead of reducing the hole diameter of the spraying holes **6*a* to increase the impedance of the spraying holes 6*a* (in other words, the impedance of the fuel supply system that guides fuel from the fuel source to the spraying holes 6*a*), the flow-path cross-sectional area of a fuel passage 22 provided in the interior thereof is made smaller than the flow-path cross-sectional area of the fuel passage 8 (see FIG. 6) in the first embodiment described above, so as to increase the impedance of the fuel flow path 22 (in other words, the impedance of the fuel supply system that guides fuel from the fuel source to the spraying holes 10**). The other constituent elements are the same as those in the first embodiment described above, and therefore, a description of those constituent elements is omitted here.

Parts that are identical to those in the first embodiment described above are assigned the same reference signs. Also, reference signs 10 in FIG. 5 are (fuel) spraying holes whose hole diameters are set so as to have the same impedance as in the related art.

The flow-path cross-sectional area of the fuel passage 22 is determined using the same procedure as the procedure described in the first embodiment. Namely, an acoustic resistance Re=0.5 at which the normal-incidence sound absorption coefficient $\alpha$ is approximately 0.9 is selected, and then, the fuel-path cross-sectional area is determined so that the acoustic resistance Re for the rated flow velocity (average flow velocity) of the fuel flowing through the fuel passage (fuel pipe) provided inside the pilot combustion burner 21 is larger than 0.5.

With the pilot combustion burner 21 according to this embodiment, it is possible to reduce, as much as possible, the propagation of pressure fluctuations from the combustion region 3 to the fuel supply system by increasing the impedance of the fuel flow path 22 (in other words, the impedance of the fuel supply system that guides fuel from the fuel source to the spraying holes 10), thereby making it possible to reduce fluctuations in the flow rate of the fuel sprayed from the spraying holes 10 into the combustion region 3.

Figure 6:
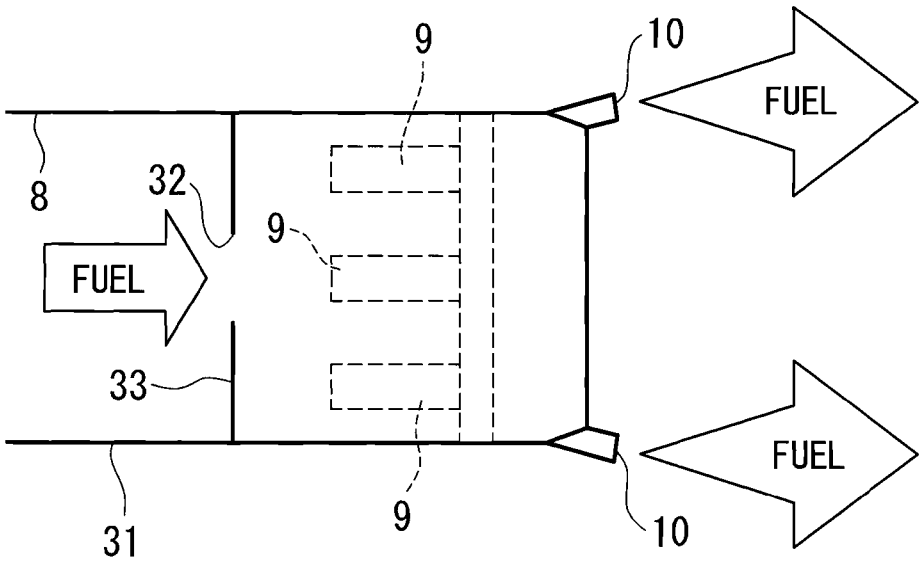
FIG. 6 is a cross-sectional view showing, in enlarged form, relevant parts of a gas-turbine combustion burner according to a third embodiment of the present invention.

A third embodiment of the gas-turbine combustion burner according to the present invention will be described with reference to FIG. 6. FIG. 6 is a cross-sectional view showing, in enlarged form, relevant parts of the gas-turbine combustion burner according to this embodiment.

A pilot combustion burner (gas-turbine combustion burner) 31 according to this embodiment differs from that in the first embodiment described above in that, instead of reducing the hole diameter of the spraying holes 6*a* to increase the impedance of the spraying holes 6*a* (in other words, the impedance of the fuel supply system that guides fuel from the fuel source to the spraying holes 6*a*), a baffle plate 33 (or orifice) provided with a slit 32 is disposed at an intermediate point in the fuel passage 8 provided in the interior thereof (more specifically, inside the fuel passage 8 at a location near the upstream side of the spraying holes 6*a*) to increase the impedance of the fuel flow path 22 (in other words, the impedance of the fuel supply system that guides fuel from the fuel source to the spraying holes 10). The other constituent elements are the same as those in the first embodiment described above, and therefore, a description of those constituent elements is omitted here.

Parts that are identical to those in the first embodiment described above are assigned the same reference signs. In addition, reference signs 10 in FIG. 6 are (fuel) spraying holes whose hole diameters are set so as to have the same impedance as in the related art.

The size of the slit 32 (or a hole provided in an orifice) is determined using the same procedure as the procedure described in the first embodiment. Namely, an acoustic resistance Re=0.5 at which the normal-incidence sound absorption coefficient $\alpha$ is approximately 0.9 is selected, and then, the slit size is determined so that the acoustic resistance Re for the rated flow velocity (average flow velocity) of the fuel flowing through the fuel passage (fuel pipe) provided in the interior of the pilot combustion burner 31 is larger than 0.5.

With the pilot combustion burner 31 according to this embodiment, it is possible to reduce, as much as possible, the propagation of pressure fluctuations from the combustion region 3 to the fuel supply system by increasing the impedance of the fuel flow path 8 (in other words, the impedance of the fuel supply system that guides fuel from the fuel source to the spraying holes 10), thereby making it possible to reduce fluctuations in the flow rate of the fuel sprayed from the spraying holes 10 into the combustion region 3.

Figure 7:
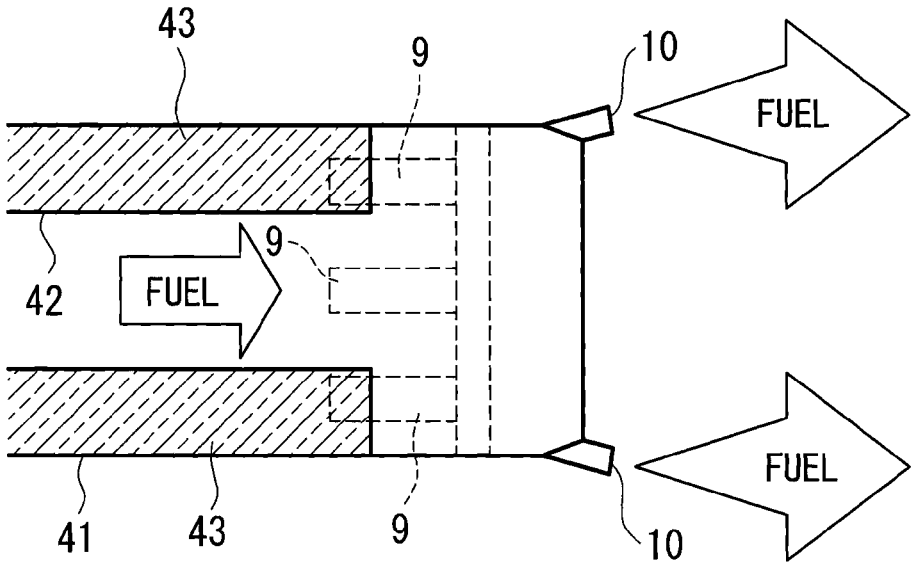
FIG. 7 is a cross-sectional view showing, in enlarged form, relevant parts of a gas-turbine combustion burner according to a fourth embodiment of the present invention.

A fourth embodiment of the gas-turbine combustion burner according to the present invention will be described with reference to FIG. 7. FIG. 7 is a cross-sectional view showing, in enlarged form, relevant parts of a gas-turbine combustion burner according to this embodiment.

A pilot combustion burner (gas-turbine combustion burner) 41 according to this embodiment differs from that of the first embodiment described above in that, instead of reducing the hole diameter of the spraying holes 6*a* to increase the impedance of the spraying holes 6*a* (in other words, the impedance of the fuel supply system that guides fuel from the fuel source to the spraying holes 6*a*), the flow-path cross-sectional area of a fuel passage 42 provided in the interior thereof is made smaller than the flow-path cross-sectional area of the fuel passage 8 (see FIG. 6) in the first embodiment described above by means of sound-absorbing material 43, such as rock wool etc., so as to increase the impedance of the fuel flow path 42 (in other words, the impedance of the fuel supply system that guides fuel from the fuel source to the spraying holes 10). The other constituent elements are the same as those in the first embodiment described above, and therefore, a description of those constituent elements is omitted here.

Parts that are identical to those in the first embodiment described above are assigned the same reference signs. In addition, reference signs 10 in FIG. 7 are (fuel) spraying holes whose hole diameters are set so as to have the same impedance as in the related art.

The flow-path cross-sectional area of the fuel passage 42 is determined using the same procedure as the procedure described in the first embodiment. Namely, an acoustic resistance Re=0.5 at which the normal-incidence sound absorption coefficient $\alpha$ is approximately 0.9 is selected, and then the flow-path cross-sectional area is determined so that the acoustic resistance Re for the rated flow velocity (average flow velocity) of the fuel that flows through the fuel passage (fuel pipe) provided inside the pilot combustion burner 41 is greater than 0.5.

With the pilot combustion burner 41 according to this embodiment, it is possible to reduce, as much as possible, the propagation of pressure fluctuations from the combustion region 3 to the fuel supply system by increasing the impedance of the fuel flow path 42 (in other words, the impedance of the fuel supply system that guides fuel from the fuel source to the spraying holes 10), thereby making it possible to reduce the fluctuations in the flow rate of the fuel sprayed from the spraying holes 10 into the combustion region 3.

In addition, pulsations in the fuel passing through the fuel flow path 42 are absorbed by the sound-absorbing material 43, and therefore, (substantially) constant fuel can always be sprayed from the spraying holes 10, making it possible to further reduce the fluctuations in the flow rate of the fuel sprayed from the spraying holes 10 into the combustion region 3.

Figure 8:
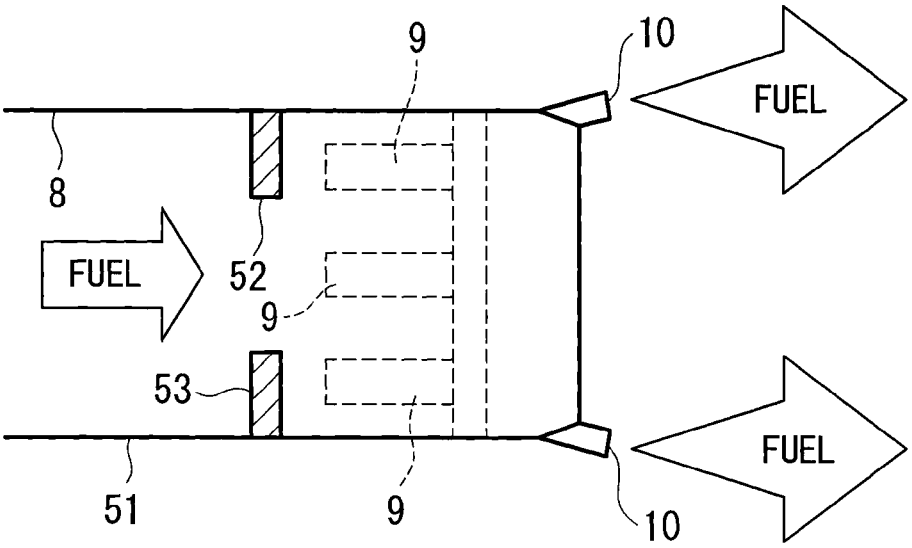
FIG. 8 is a cross-sectional view showing, in enlarged form, relevant parts of a gas-turbine combustion burner according to a fifth embodiment of the present invention.

A fifth embodiment of the gas-turbine combustion burner according to the present invention will be described with reference to FIG. 8. FIG. 8 is a cross-sectional view showing, in enlarged form, relevant parts of the gas-turbine combustion burner according to this embodiment.

A pilot combustion burner (gas-turbine combustion burner) 51 according to this embodiment differs from that in the first embodiment described above in that, instead of reducing the hole diameter of the spraying holes 6*a* to increase the impedance of the spraying holes 6*a* (in other words, the impedance of the fuel supply system that guides the fuel from the fuel source to the spraying holes 6*a*), a slit 52 is provided at an intermediate position in the fuel passage 8 provided in the interior thereof (more specifically, in the fuel passage 8 at a location close to the upstream side of the spraying holes 6*a*), and a baffle plate 53 made of a sound-absorbing material such as rock wool (or an orifice made of a sound-absorbing material such as rock wool) is disposed thereat to increase the impedance of the fuel flow path 8 (in other words, the impedance of the fuel-supply system that guides fuel from the fuel source to the spraying holes 10). The other constituent elements are the same as those in the first embodiment described above, and a description of those constituent elements is omitted here.

Parts identical to those in the first embodiment described above are assigned the same reference signs. In addition, reference signs 10 in FIG. 8 are (fuel) spraying holes whose hole diameters are set so as to have the same impedance as in the related art.

The size of the slit 52 (or the hole provided in the orifice) is determined using the same procedure as the procedure described in the first embodiment. Namely, an acoustic resistance Re=0.5 at which the normal-incidence sound absorption coefficient $\alpha$ is approximately 0.9 is selected, and then the slit size is determined so that the acoustic resistance Re for the rated flow velocity (average flow velocity) of the fuel that flows through the fuel passage (fuel pipe) provided in the interior of the pilot combustion burner 51 is greater than 0.5.

With the pilot combustion burner 51 according to this embodiment, it is possible to reduce, as much as possible, the propagation of pressure fluctuations from the combustion region 3 to the fuel supply system by increasing the impedance of the fuel flow path 8 (in other words, the impedance of the fuel supply system that guides fuel from the fuel source to the spraying holes 10), thereby making it possible to reduce the fluctuations in the flow rate of the fuel sprayed from the spraying holes 10 into the combustion region 3.

In addition, pulsations in the fuel passing through the fuel flow path 8 are absorbed by the baffle plate 53 made of the sound-absorbing material (or the orifice made of the sound-absorbing material), and therefore, (substantially) constant fuel can always be sprayed from the spraying holes 10, which makes it possible to further reduce the fluctuations in the flow rate of the fuel sprayed from the spraying holes 10 into the combustion region 3.

Figure 9:
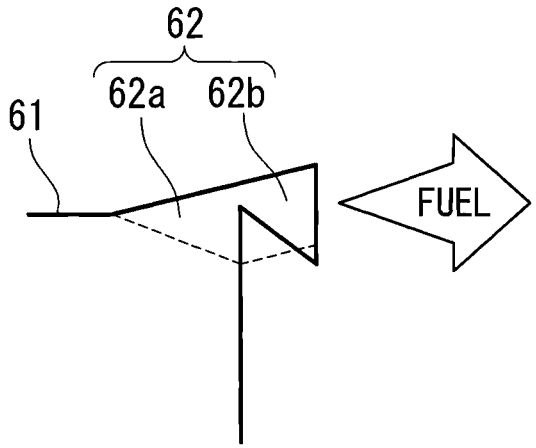
FIG. 9 is a cross-sectional view showing, in enlarged form, relevant parts of a gas-turbine combustion burner according to a sixth embodiment of the present invention.

A sixth embodiment of the gas-turbine combustion burner according to the present invention will be described with reference to FIG. 9. FIG. 9 is a cross-sectional view showing, in enlarged form, relevant parts of the gas-turbine combustion burner according to this embodiment. The dotted line in FIG. 9 indicates the outline of the spraying hole 6*a* described above.

A pilot combustion burner (gas-turbine combustion burner) 61 according to this embodiment differs from those in the first to fifth embodiments described above in that spraying holes 62 are provided instead of the spraying holes 6*a*. The other constituent elements are the same as those in the first to fifth embodiments described above, and a description of those constituent elements will be omitted here.

As shown in FIG. 9, the spraying holes 62 include a reduced-diameter portion 62*a*, which is gradually reduced in diameter from an inlet thereof to an intermediate point in the flow path length, and a wide-diameter portion 62*b*, which is gradually increased in diameter from the intermediate point in the flow path length to an outlet thereof. The hole diameter of the spraying holes 62 is determined using the same procedure as the procedure described in the first embodiment. Namely, an acoustic resistance Re=0.5 at which the normal-incidence sound absorption coefficient $\alpha$ is approximately 0.9 is selected, and then the hole diameter is determined so that the acoustic resistance Re for the rated flow velocity (average flow velocity) of the fuel flowing through the fuel passage (fuel pipe) provided inside the pilot combustion burner 61 is greater than 0.5.

With the pilot combustion burner 61 according to this embodiment, it is possible to reduce, as much as possible, the propagation of pressure fluctuations from the combustion region 3 to the fuel supply system by increasing the impedance of the spraying holes 62 (in other words, the impedance of the fuel supply system that guides fuel from the fuel source to the spraying holes 62), thereby making it possible to reduce the fluctuations in the flow rate of the fuel sprayed from the spraying holes 62 into the combustion region 3.

In addition, a pressure loss occurs at a constricted portion formed at the connecting portion between the reduced-diameter portion 62*a* and the wide-diameter portion 62*b* (in other words, where the outlet of the reduced-diameter portion 62*a* meets the inlet of the wide-diameter portion 62*b*); therefore, the impedance of the spraying holes 62 becomes even larger, and thus the propagation of pressure fluctuations from the combustion region 3 to the fuel supply system can be reduced even more, thereby making it possible to further reduce the fluctuations in the flow rate of the fuel sprayed from the spraying holes 62 into the combustion region 3.

Figure 10:
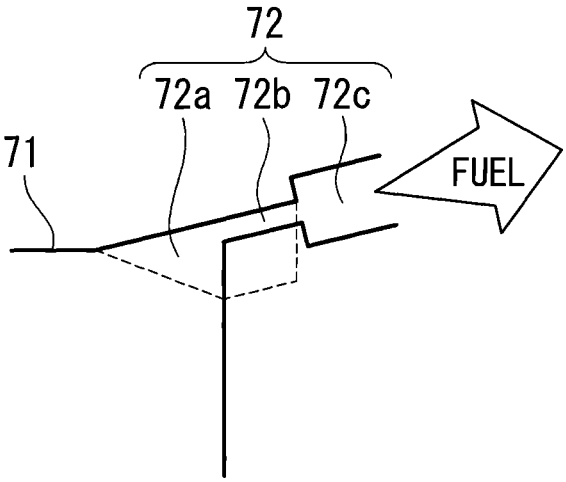
FIG. 10 is a cross-sectional view showing, in enlarged form, relevant parts of a gas-turbine combustion burner according to a seventh embodiment of the present invention.

A seventh embodiment of the gas-turbine combustion burner according to the present invention will be described with reference to FIG. 10. FIG. 10 is a cross-sectional view showing, in enlarged form, relevant parts of a gas-turbine combustion burner according to this embodiment. The dotted line in FIG. 10 indicates the outline of the spraying hole 6*a* described above.

A pilot combustion burner (gas-turbine combustion burner) 71 according to this embodiment differs from those in the first to fifth embodiments in that spraying holes 72 are provided instead of the spraying holes 6*a*. The other constituent elements are the same as those in the first to fifth embodiments described above, and therefore, a description of those constituent elements will be omitted here.

As shown in FIG. 10, the spraying holes 72 include a reduced-diameter portion 72*a* that extends from an inlet thereof to a point at ⅓ of the flow path length, a straight portion (constricted portion) 72*b* that extends from the point at ⅓ of the flow path length to a point at ⅔ of the flow path length, and a wide-diameter portion 72*c* that extends from the point at ⅔ of the flow path length to an outlet thereof. The reduced-diameter portion 72*a* is a portion whose flow-path cross-sectional area gradually reduces in diameter from the inlet of the spraying hole 72 to a point at ⅓ of the flow path length of the spraying hole 72, and the straight portion 72*b* is a portion that has a constant flow-path cross-sectional area from the point at ⅓ of the flow path length of the spraying hole 72 to the point at ⅔ of the flow path length of the spraying hole 72. The wide-diameter portion 72*c* is a portion formed so as to have a larger flow-path cross-sectional area than the flow-path cross-sectional area of the straight portion 72*b* and so that the flow-path cross-sectional area thereof is constant from the point at ⅔ of the flow path length of the spraying hole 72 to the outlet of the spraying hole 72. In addition, the hole diameter of the spraying hole 72 is determined using the same procedure as the procedure described in the first embodiment. Namely, an acoustic resistance Re=0.5 at which the normal-incidence sound adsorption coefficient α is approximately 0.9 is selected, and then the hole diameter is determined so that the acoustic resistance Re for the rated flow velocity (average flow velocity) of the fuel that flows through the fuel passage (fuel pipe) provided inside the pilot combustion burner 71 is greater than 0.5.

In this embodiment, the inner diameter (hole diameter) of the wide-diameter portion 72*c* is set to be about 1.5 to 5 times the inner diameter (hole diameter) of the straight portion 72*b*.

With the pilot combustion burner 71 according to this embodiment, it is possible to reduce, as much as possible, the propagation of pressure fluctuations from the combustion region 3 to the fuel supply system by increasing the impedance of the spraying holes 72 (in other words, the impedance of the fuel supply system that guides fuel from the fuel source to the spraying holes 72), thereby making it possible to reduce the fluctuations in the flow rate of the fuel sprayed from the spraying holes 72 into the combustion region 3.

In addition, a pressure loss occurs at a stepped portion (edge portion) formed at the connecting portion between the straight portion 72*b* and the wide-diameter portion 72*c*; therefore, the impedance of the spraying holes 72 becomes even larger, and thus the propagation of pressure fluctuations from the combustion region 3 to the fuel supply system can be reduced even more, thereby making it possible to further reduce the fluctuations in the flow rate of the fuel sprayed from the spraying holes 72 into the combustion region 3.

A pressure loss occurs at a constricted portion formed at the connecting portion between the reduced-diameter portion 72*a* and the straight portion 72*b* (in other words, where the outlet of the reduced-diameter portion 72*a* meets the inlet of the straight portion 72*b*); therefore, the impedance of the spraying holes 72 becomes even larger, and thus the propagation of pressure fluctuations from the combustion region 3 to the fuel supply system can be reduced even more, thereby making it possible to further reduce the fluctuations in the flow rate of the fuel sprayed from the spraying holes 72 into the combustion region 3.

Furthermore, with the pilot combustion burner 71 according to this embodiment, it is possible to effectively reduce the acoustic of flowing fuel in the wide-diameter portion 72*c*, whose inner diameter is set to be 1.5 to 5 times the inner diameter of the straight portion 72*b*.

Figure 11:
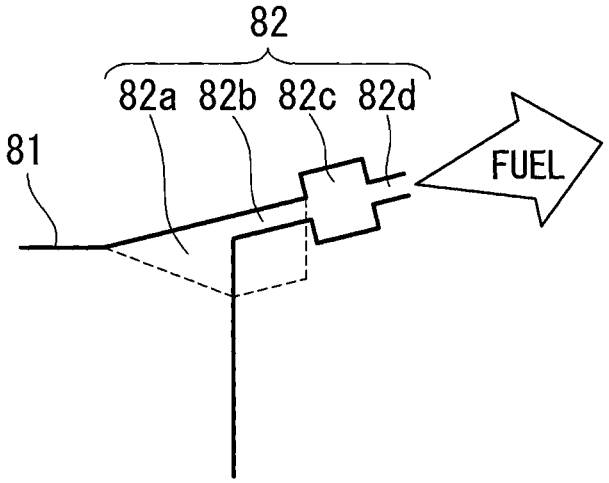
FIG. 11 is a cross-sectional view showing, in enlarged form, relevant parts of a gas-turbine combustion burner according to an eighth embodiment of the present invention.

An eighth embodiment of the gas-turbine combustion burner according to the present invention will be described with reference to FIG. 11. FIG. 11 is a cross-sectional view showing, in expanded form, relevant parts of the gas-turbine combustion burner according to this embodiment. The dotted line in FIG. 11 indicates the outline of the above-described spraying hole 6*a*.

A pilot combustion burner (gas-turbine combustion burner) 81 according to this embodiment differs from those in the first to fifth embodiments described above in that spraying holes 82 are provided instead of the spraying holes 6*a*. The other constituent elements are the same as those in the first to fifth embodiments described above, and therefore, a description of those constituent elements will be omitted here.

As shown in FIG. 11, the spraying holes 82 include a reduced-diameter portion 82*a* that extends from an inlet thereof to a point at ¼ of the flow path length, a first straight portion (constricted portion) 82*b* that extends from the point at ¼ of the flow path length to a point at ¾ of the flow path length, a wide-diameter portion 82*c* that extends from the point at ¾ of the flow path length to a point at ¾ of the flow path length, and a second straight portion (constricted portion) 82*d* that extends from the point at ¾ of the flow path length to an outlet thereof. The reduced-diameter portion 82*a* is a portion whose flow-path cross-sectional area gradually reduces in diameter from the inlet of the spraying hole 82 to a point at ¼ of the flow path length of the spraying hole 82, and the first straight portion 82*b* is a portion having a constant flow-path cross-sectional area from the point at ¼ of the flow path length of the spraying hole 82 to the point at ¾ of the flow path length of the spraying hole 82. The wide-diameter portion 82*c* is a portion formed so as to have a flow-path cross-sectional area larger than the flow-path cross-sectional area of the first straight portion 82*b* and so that the flow-path cross-sectional area thereof is constant from the point at ¾ of the flow path length of the spraying hole 82 to the point at ¾ of the flow path length of the spraying hole 82. The second straight portion 82*d* is a portion formed so as to have the same flow-path cross-sectional area as that of the first straight portion 82*b* and so that the flow-path cross-sectional area thereof is constant from the point at ¾ of the flow path length of the spraying hole 82 to the outlet of the spraying hole 82. In addition, the hole diameter of the spraying hole 82 is determined using the same procedure as the procedure described in the first embodiment. Namely, an acoustic resistance Re=0.5 at which the normal-incidence sound absorption coefficient α is approximately 0.9 is selected, and then the hole diameter is determined so that the acoustic resistance Re for the rated flow velocity (average flow velocity) of the fuel flowing through the fuel passage (fuel pipe) provided inside the pilot combustion burner 81 is greater than 0.5.

In this embodiment, the inner diameter (hole diameter) of the wide-diameter portion 82*c* is set to be 1.5 to 5 times the inner diameter (hole diameter) of the first straight portion 82*b*.

With the pilot combustion burner 81 according to this embodiment, it is possible to reduce, as much as possible, the propagation of pressure fluctuations from the combustion region 3 to the fuel supply system by increasing the impedance of the spraying holes 82 (in other words, the impedance of the fuel supply system that guides fuel from the fuel source to the spraying holes 82), thereby making it possible to reduce the fluctuations in the flow rate of the fuel sprayed from the spraying holes 82 into the combustion region 3.

In addition, pressure losses occur at a first stepped portion (first edge portion) formed at the connecting portion between the first straight portion 82*b* and the wide-diameter portion 82*c*, and also at a second stepped portion (second edge portion) formed at the connecting portion between the wide-diameter portion 82*c* and the second straight portion 82*d*; therefore, the impedance of the spraying holes 82 becomes even larger, and thus the propagation of pressure fluctuations from the combustion region 3 to the fuel supply system can be reduced even more, thereby making it possible to further reduce the fluctuations in the flow rate of the fuel sprayed from the spraying holes 82 into the combustion region 3.

A pressure loss occurs at a constricted portion formed at the connecting portion between the reduced-diameter portion 82*a* and the first straight portion 82*b* (in other words, where the outlet of the reduced-diameter portion 82*a* meets the inlet of the first straight portion 82*b*); therefore, the impedance of the spraying holes 82 becomes even larger, and thus the propagation of pressure fluctuations from the combustion region 3 to the fuel supply system can be reduced even more, thereby making it possible to further reduce the fluctuations in the flow rate of the fuel sprayed from the spraying holes 82 into the combustion region 3.

Furthermore, with the pilot combustion burner 81 according to this embodiment, it is possible to effectively reduce the acoustic of flowing fuel in the wide-diameter portion 82*c*, whose inner diameter is set to be 1.5 to 5 times the inner diameter of the first straight portion 82*b*.

The present invention is not restricted to the embodiments described above; for example, it can be realized by combining the embodiments described above as appropriate, or by making changes or modifications.

Furthermore, the present invention need not be applied only to the pilot combustion burner 6; it can also be applied to the main combustion burners 5.

In addition, the flow path lengths of the reduced-diameter portion 62*a* and the wide-diameter portion 62*b* described in the sixth embodiment; the reduced-diameter portion 72*a*, the straight portion 72*b*, and the wide-diameter portion 72*c* described in the seventh embodiment; and the reduced-diameter portion 82*a*, the first straight portion 82*b*, the wide-diameter portion 82*c*, and the second straight portion 82*d* described in the eighth embodiment are not restricted to the embodiments described above; modifications are permissible as appropriate.

REFERENCE SIGNS LIST

1 gas-turbine combustor
2 combustion cylinder
3 combustion region
6 pilot combustion burner (gas-turbine combustion burner)
6*a* fuel spraying hole
8 fuel flow path
10 fuel spraying hole
21 gas-turbine combustion burner
22 fuel flow path
31 gas-turbine combustion burner
32 slit
33 baffle plate
41 gas-turbine combustion burner
42 fuel flow path
43 sound-absorbing material
51 gas-turbine combustion burner
52 slit
53 baffle plate
61 gas-turbine combustion burner
62 fuel spraying hole
62*a* reduced-diameter portion
62*b* wide-diameter portion
71 gas-turbine combustion burner
72 fuel spraying hole
72*a* reduced-diameter portion
72*b* straight portion
72*c* wide-diameter portion
81 gas-turbine combustion burner
82 fuel spraying hole
82*a* reduced-diameter portion
82*b* first straight portion
82*c* wide-diameter portion
82*d* second straight portion

The invention claimed is:

1. A gas-turbine combustion burner which is provided, at a distal end thereof, with a fuel injector that sprays fuel through an outlet thereof into a combustion region formed inside a combustion cylinder of a gas-turbine combustor; wherein a fuel flow path that guides the fuel, which is supplied from a fuel source, to the fuel injector is formed in the interior of the burner, wherein the fuel injector comprises a tube-shaped portion which protects from an outer circumferential edge of the distal end of the burner, wherein the tube-shaped portion comprises an internal fuel passage extending from an inlet to the outlet of the fuel injector, the internal fuel passage in fluid communication with the fuel flow path, wherein a baffle plate having a constant-diameter opening is provided at an intermediate position in the fuel flow path, wherein a value of an acoustic resistance for a flow velocity of fuel flowing through the fuel flow path is determined from a normal-incidence sound absorption coefficient, which indicates the ratio of a pressure wave absorbed between the baffle plate and the outlet with respect to the pressure wave propagated from the combustion region upstream of the baffle plate, and wherein the diameter of the opening is set so that the acoustic resistance for the flow velocity of fuel flowing through the fuel flow path is larger than an acoustic resistance at which the normal-incidence sound absorption coefficient is at a desired value.

2. A gas-turbine combustion burner according to claim 1, wherein the baffle plate is made of a sound-absorbing material.

3. A gas-turbine combustion burner which is provided, at a distal end thereof, with a fuel injector that sprays fuel from an outlet thereof into a combustion region formed inside a combustion cylinder of a gas-turbine combustor; wherein a fuel flow path that guides the fuel, which is supplied from a fuel source, to the fuel injector is formed in the interior of the burner, wherein the fuel injector comprises a tube-shaped portion which projects from an outer circumferential edge of the distal end of the burner, wherein the tube-shaped portion comprises an internal fuel passage having an inlet and a fuel passage length extending from the inlet to the outlet of the fuel injector, the internal fuel passage in fluid communication with the fuel flow path, wherein the internal fuel passage further comprises a reduced-diameter portion that gradually reduces in diameter from the inlet to at least one constant diameter portion located downstream from the reduced-diameter portion, and a wide-diameter portion having an inner diameter which is larger than an inner diameter of the at least one constant diameter portion, located downstream from the at least one constant-diameter portion, wherein a value of an acoustic resistance for a flow velocity of fuel flowing through the internal fuel passage is determined from a normal-incidence sound absorption coefficient, which indicates the ratio of a pressure wave absorbed in the fuel injector with respect to the pressure wave propagated from the combustion region through and upstream of the fuel injector, and wherein a diameter of the internal fuel passage is set so that the acoustic resistance for the flow velocity of fuel flowing through the internal fuel passage is larger than an acoustic resistance at which the normal-incidence sound absorption coefficient is at a desired value.

4. A gas-turbine combustion burner according to claim 3, wherein the reduced-diameter portion extends to a point at ¼ of the fuel passage length, a first constant-diameter portion that extends from the point at ¼ of the fuel passage length to a point at ¾ of the fuel passage length, the wide-diameter portion extends from the point at ¾ of the fuel passage length to a point at ¾ of the fuel passage length, and a second constant-diameter portion that extends from the point at ¾ of the fuel passage length to the outlet of the fuel injector.

5. A gas-turbine combustion burner according to claim 4, wherein the inner diameter of the wide-diameter portion of the internal fuel passage is set to be 1.5 times the inner diameter of the first constant-diameter portion of the internal fuel passage.

6. A gas-turbine combustion burner according to claim 3, wherein the reduced-diameter portion extends to a point at ⅓ of the fuel passage length, the constant-diameter portion extends from the point at ⅓ of the fuel passage length to a point at ⅔ of the fuel passage length, and the wide-diameter portion extends from the point at ⅔ of the fuel passage length to the outlet of the fuel injector.

7. A gas-turbine combustion burner according to claim 6, wherein the inner diameter of the wide-diameter portion of the internal fuel passage is set to be 1.5 to 5 times the inner diameter of the constant-diameter portion of the internal fuel passage.

8. A gas-turbine combustor comprising a gas-turbine combustion burner according to claim 3.

* * * * *